US005248865A

United States Patent [19]

Tyler

[11] Patent Number: 5,248,865

[45] Date of Patent: Sep. 28, 1993

[54] APPARATUS FOR INDUCTION HEATING OF BEARINGS OR THE LIKE

[76] Inventor: George W. Tyler, P.O. Box 16007, Brighton Beach 4052 Durban, South Africa

[21] Appl. No.: 949,902

[22] Filed: Sep. 23, 1992

Related U.S. Application Data

[63] Continuation-in-part of Ser. No. 867,777, Apr. 13, 1992, abandoned, which is a continuation of Ser. No. 610,555, Nov. 8, 1990, abandoned.

[30] Foreign Application Priority Data

Dec. 18, 1989 [ZA] South Africa ..... 89/9658

[51] Int. Cl.[5] ..... H05B 6/14

[52] U.S. Cl. ..... 219/10.57; 219/10.67; 219/10.77

[58] Field of Search ..... 219/10.57, 10.75, 10.77, 219/10.67, 10.491, 10.79

[56] References Cited

U.S. PATENT DOCUMENTS

| | | | |
|---|---|---|---|
| 2,836,694 | 5/1958 | Emerson | 219/10.41 |
| 3,154,663 | 10/1964 | Halvorsen | 219/10.491 |
| 3,187,155 | 6/1965 | Beckert et al. | 219/10.75 |
| 3,435,170 | 3/1969 | Smith | 219/10.491 |
| 3,895,295 | 7/1975 | Mittelmann | 219/10.75 |
| 3,921,092 | 11/1975 | Schatz | 219/10.77 |
| 4,013,742 | 3/1977 | Lang | 219/10.49 |
| 4,032,740 | 6/1977 | Mittelmann | 219/10.77 |
| 4,311,896 | 1/1982 | Junya | 219/10.57 |
| 4,317,975 | 3/1982 | Mizukawa et al. | 219/10.77 |
| 4,357,512 | 11/1982 | Nishimoto et al. | 219/10.77 |

FOREIGN PATENT DOCUMENTS

| | | |
|---|---|---|
| 27306 | 4/1981 | European Pat. Off. . |
| 143091 | 5/1985 | European Pat. Off. . |
| 53-43646 | 4/1978 | Japan . |
| 1454783 | 11/1976 | United Kingdom . |

OTHER PUBLICATIONS

Tudbury, "Basics of Induction Heating" vol. 1, pp. 6–8, 26, 70 & 71, John Rider Publisher, 1960.

*Primary Examiner*—Philip H. Leung

*Attorney, Agent, or Firm*—Bell, Seltzer, Park & Gibson

[57] ABSTRACT

An induction heater for ring-like articles such as bearings includes a hinged clamp-like magnetically inductive core of ferrite which can be opened to receive and closed to accommodate the article to be heated and which has a primary winding and a source of high frequency current derived from a switched mode power supply; and having temperature sensors and safety circuits adapted to prevent damage due to too high temperatures and to ensure proper operation for articles of differing sizes.

5 Claims, 3 Drawing Sheets

APPARATUS FOR INDUCTION HEATING OF BEARINGS OR THE LIKE

RELATED APPLICATIONS

Figure 1:
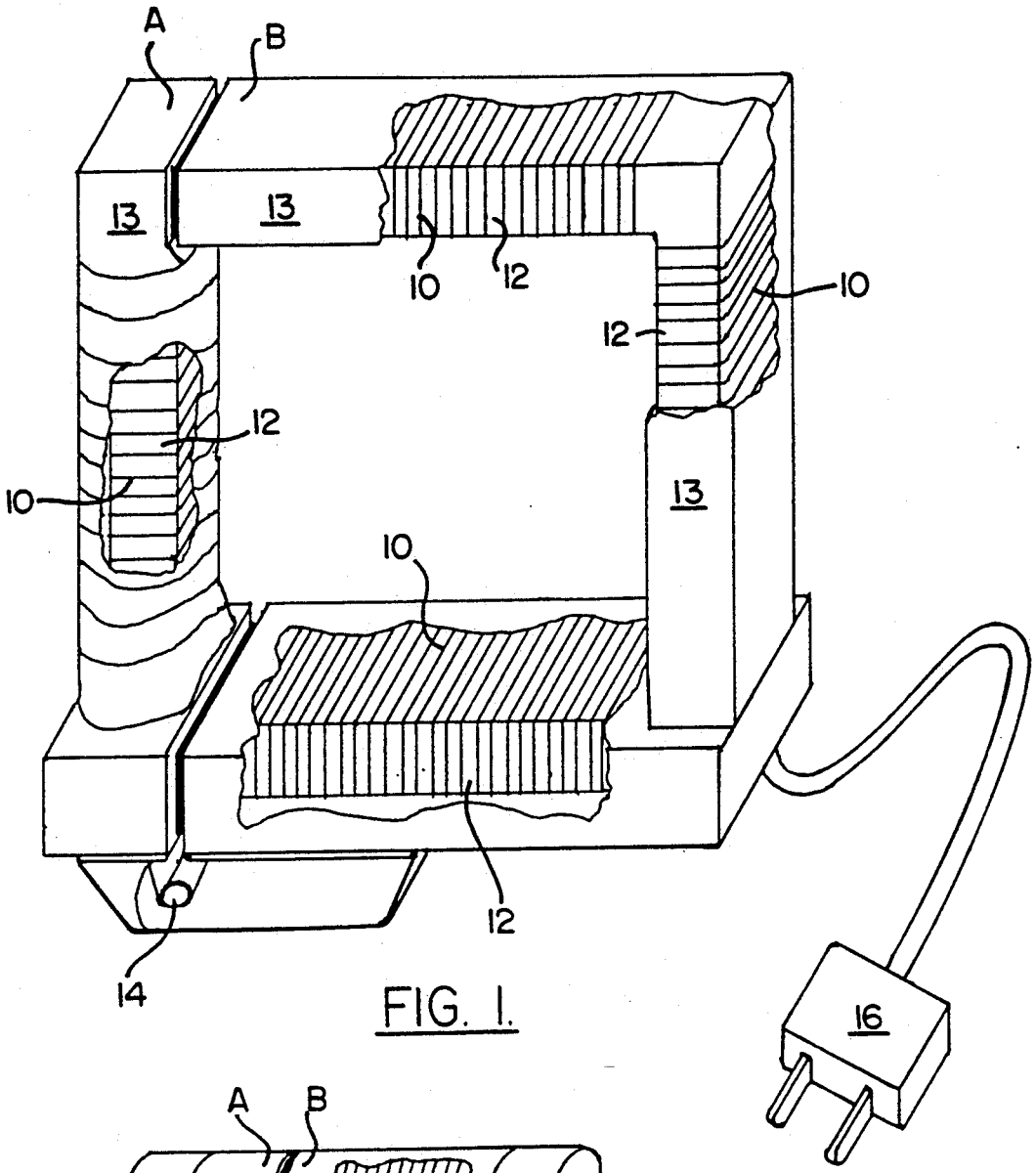

This application is a continuation-in-part of U.S. application Ser. No. 07/867,777 filed Apr. 13, 1992, now abandoned which is a continuation of U.S. application Ser. No. 07/610,555 filed Nov. 8, 1990 (now abandoned).

FIELD OF THE INVENTION

This invention relates to the induction heating of bearings and other ring-like articles which are required to be located over shafts, pipes and the like.

BACKGROUND OF THE INVENTION

Induction heating is well known in the art and has conventionally been achieved by means of apparatus which constitutes a primary winding of a transformer with the bearing ring forming the secondary winding. This is accomplished by providing a horseshoe construction for the primary winding and having a connecting piece to complete the circuit, the connecting piece being adapted to receive the bearing in inductive contact.

Many types of induction heaters are presently in use. Their use, however, is limited by several disadvantages derived from the fact that induction heating presently involves passing a high-power current, often of several kilowatts, through an inducting coil to effect high heat in the conducting metal; and the primary winding is generally of normal supply frequency and is generally of substantial size which makes it difficult to transport. Another disadvantage associated with prior art arrangements is that the bearing requires to be demagnetized during or after the heating operation.

In an example of the prior art, U.S. Pat. No. 2,836,694 (Emerson) discloses an induction heating method by saturating a magnetic workpiece with maximum magnetic flux density to effect the heating process. The DC power source is used so as not to overload the RF generator at temperatures below the Curie point of the workpiece. The present invention seeks to utilize low flux density and is concerned with conductive workpieces. Whereas Emerson relies on magnetization of the workpiece, the present invention seeks to minimize or eliminate the magnetization of the workpiece.

In another example of the prior art U.S. Pat. No. 3,187,155 (Beckert) recognizes the necessity for a separate demagnetization step but he achieves this with a bulky and expensive arrangement of a motor and variable voltage transformer to remove the magnetism created by the application of a low frequency (60 Hz) current in the initial heating step. By a careful choice of parameters the present invention achieves the heating step without having to resort to an additional demagnetizing step which is not only expensive and time consuming but also involves the use of bulky non-portable equipment.

U.S. Pat. No. 4,311,896 (Junya) uses a 60 Hz current to excite a coil 2 surrounding core 4 by a connection 10. Junya also fails to recognize the advantages of the present invention which uses certain parameters and items such as a switched mode power supply at high frequency in a controlled manner.

Japanese patent 53-43646 uses eddy currents to heat objects in order to weld them together; whereas the present invention uses the workpiece as a secondary to produce circulatory currents in the workpiece. The Toyota invention is not applicable to the heating of bearings—in fact, if it was used to heat bearings, the heating effect would only be obtained in the zone including the gap with the result that a bearing would merely be welded together in such a zone. It is an object of the present invention to heat a bearing so that in can be fitted to a shaft—it does not seek to weld a few bearing balls to the bearing bed.

It is an object of the present invention to obviate some of the disadvantages of the prior art and to provide apparatus which is easily portable and which does not magnetize a bearing or ring unduly, thereby avoiding the necessity for providing a demagnetization step and apparatus therefor. It will be appreciated that a bearing must remain free of magnetism to prevent attraction of metallic particles which could cause considerable damage.

SUMMARY OF THE INVENTION

According to the invention an induction heater for a ring-like article comprises a clamp-like magnetically permeable core of a ferrite material having a hinged portion movable between an open and closed position, the core permitting the mounting of the ring-like article around a portion of the core when the core is in its open position;

a winding surrounding the core for energizing it, the winding forming the primary of a transformer system with the article forming the secondary of the transformer system;

a switched mode high frequency power supply connected to the primary winding, the switched mode power supply operating at a sufficiently high frequency so that low magnetic flux density is produced in the core and the article to avoid the need for demagnetizing the article after it has been inductively heated;

phase locked loop frequency control means to detect the current load imposed by the article and so to control the supply frequency depending on the detected load so that the core and article are in resonance; and temperature sensing means and switching means to sense the temperature of the inductively heated article and to immediately terminate the current supply to the primary winding when the sensed temperature reaches a predetermined value.

The important advantage of the present invention is that due to the use of high frequency by means of a switched mode power supply, a low magnetic flux is produced which effectively prevents the article from becoming magnetized, and this is guaranteed by means of the control means which ensures that the core and the supply frequency are in resonance.

The result of the control of frequency results in the oscillations in the article and the clamp dying away. The selection of integers of the apparatus of the invention allows a very small and compact unit to be produced which is easily transportable.

One of the advantages of the operating at a resonant frequency is that a reduction in EMI (Electromagnetic Interference) and RFI (Radio Frequency Interference) is realized. The reason being that the output power transistors switching transitions occur near or at zero voltage or current.

EMBODIMENT OF THE INVENTION

Figure 2:
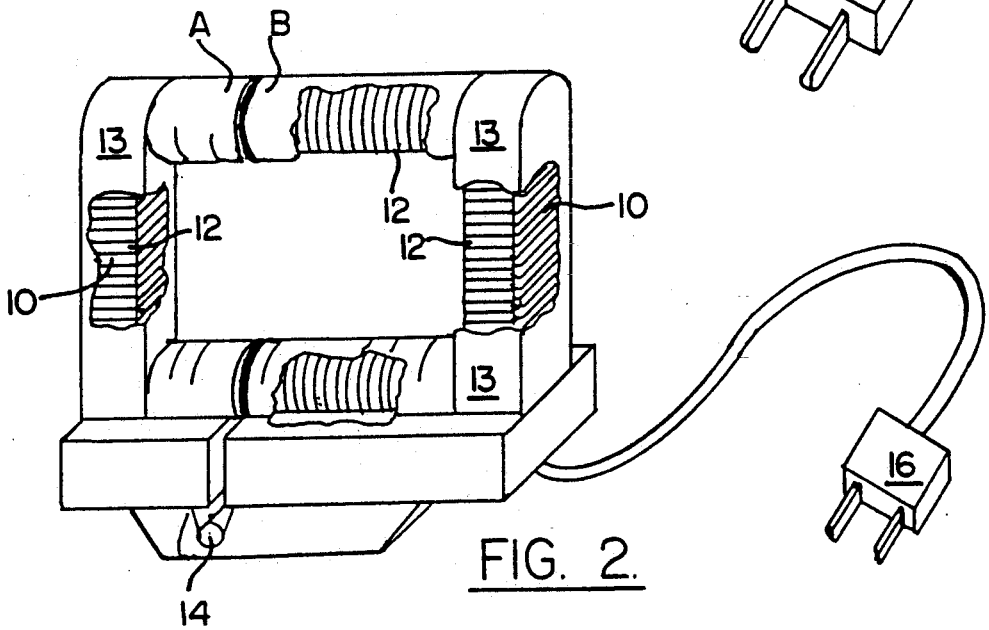
Figure 3:
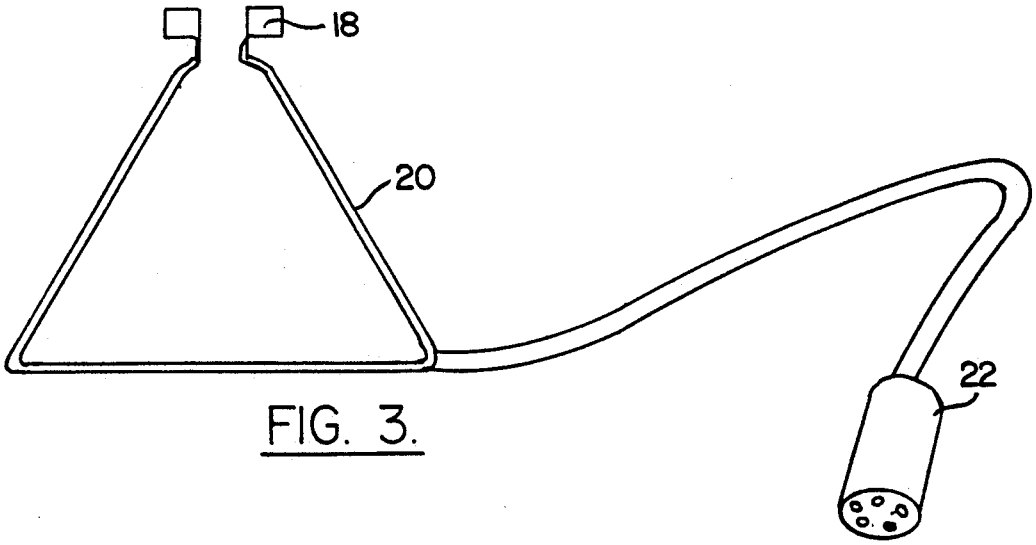
Figure 4:
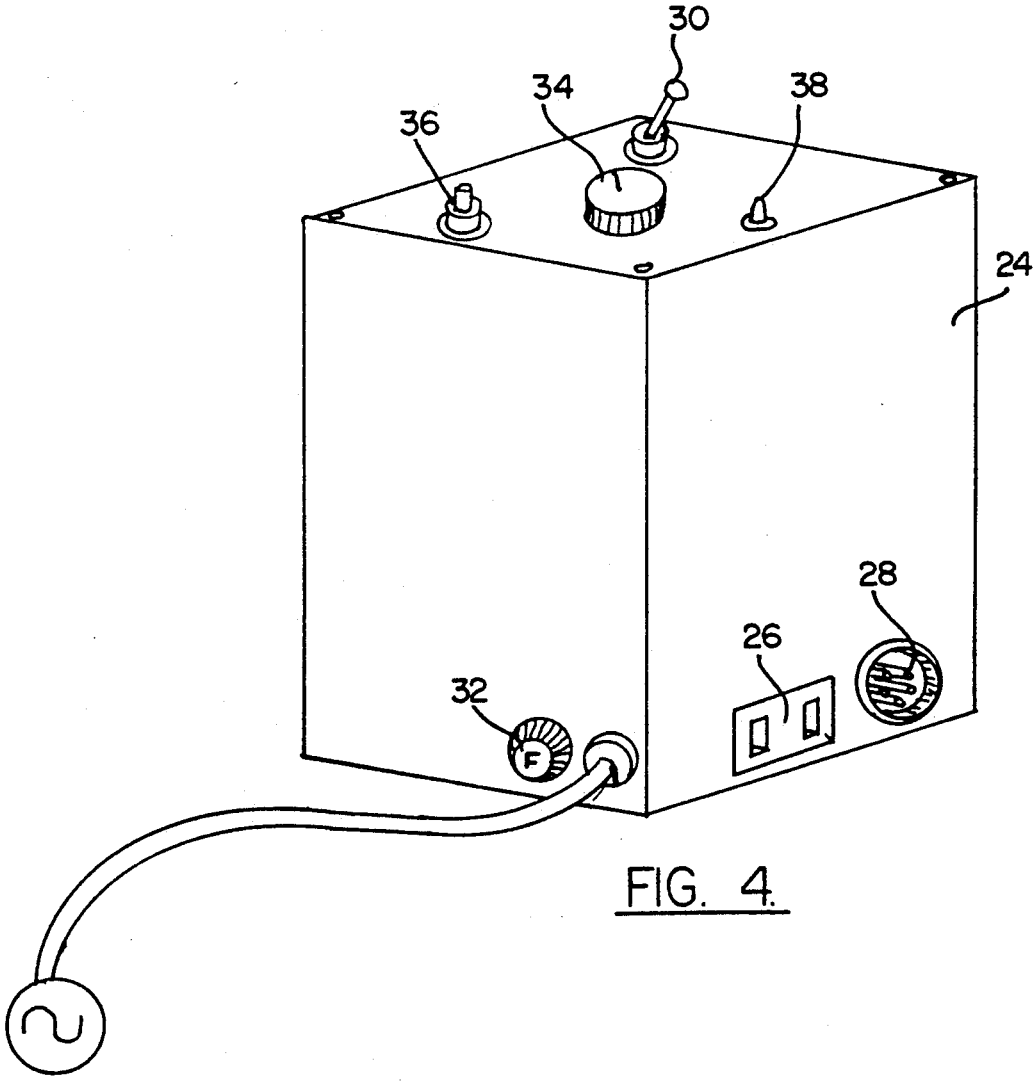
Figure 5:
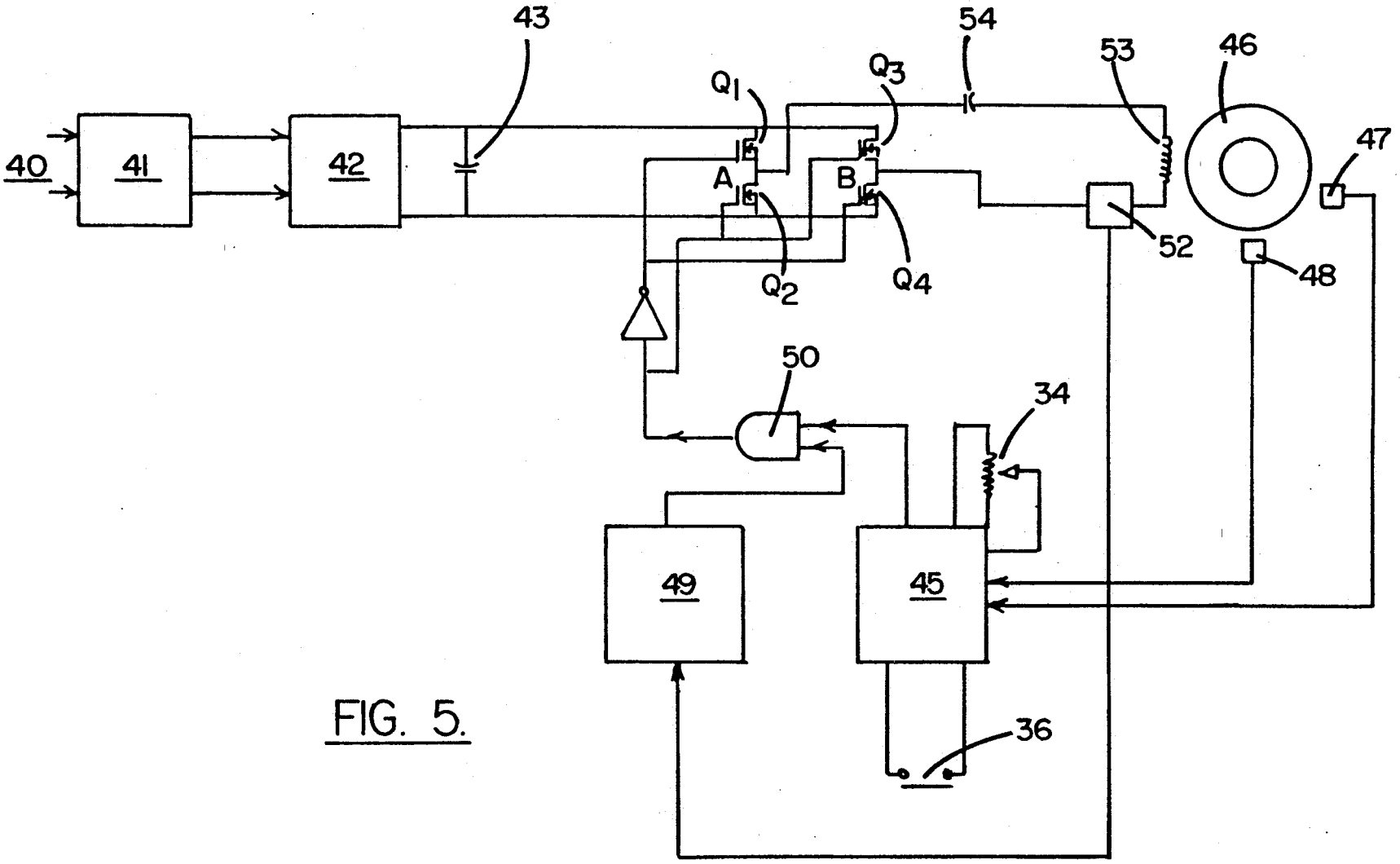

An embodiment of the invention is described below with reference to the accompanying drawings, wherein;

FIG. 1 is a diagrammatic, partially cutaway view of a heater for large bearings or ring-like forms according to the invention, FIG. 2 is a diagrammatic, partially cutaway view of a heater for small bearings or ring-like forms according to the invention, FIG. 3 is a diagrammatic view of a temperature sensor for use in the invention, FIG. 4 is a diagrammatic view of the housing of the high frequency supply for use in the invention, FIG. 5 is a block diagram of a switched mode power supply for the heater.

Referring to FIGS. 1 and 2, a primary coil 10 is provided on the ferrite cores 12, which are hinged at 14 to enable the bearing or ring-like form to be fitted over either point A or point B. The primary coil 10 is associated with a switched mode power supply 40, and is connected to this by means of connector 16. A diagrammatic view of the housing for the switched mode power supply 40, is shown in FIG. 4 and a block diagram of the circuit is shown in FIG. 5. The ferrite cores 12 are enclosed in a heat resistant and non-electrically conductive housing 13.

Referring to FIG. 3, two temperature sensitive I.C.'s 18, are mounted on a spring clamp 20; one measures the temperature of the bearing or ring-like form, the other measures the ambient or reference temperature. The two I.C.'s 18 are associated with the switched mode power supply 40 and are connected to it by means of connector 22.

Referring to FIG. 4, the switched mode power supply 40, is housed, in this form of the invention, in a aluminum case 24. The primary coil 10 is connected via socket 26 and the temperature sensors 18 are connected via socket 28. The mains supply is connected through switch 30 and fuse 32. Temperature control of the sensors 18 is effected by means of a potentiometer 34. The switched mode power supply 40 is activated by push button 36 and an indication of the active state is made by the LED 38.

Referring to FIG. 5, a domestic mains supply 40 is first filtered at 41 and then rectified to direct current by rectifier 42. Capacitors 43 serve to smooth the current.

When the current is first switched on and the push button switch 36 pressed, the line from the on/off control 45 goes HIGH, thereby closing the circuit across the bearing 46 between the contact 47 and the metal housing of the temperature sensor 48. The temperature being sensed is set at a value below that required by the potentiometer 34.

Once the line is HIGH, the signals from the frequency control unit 49 can pass through the AND gate 50. As can be seen from the diagram, Q1 and Q4 are turned on simultaneously, at that same time Q2 and Q3 are turned off. Thus when Q2 and Q3 are on, Q1 and Q4 are off. Therefore, nodes A and B are alternately switched between the 320 V and 0 V at a frequency which is around 20 KHz, the frequency is very quickly adjusted by means of a phase locked loop system inside the frequency control unit 49 using information fed back from the current sensor 52. Since the inductance of the primary coil 53 will vary according to the size of the bearing 46 the frequency is adjusted so that the inductive load and output capacitor 54 are in resonance.

Once the predetermined temperature is sensed or if the contact across the bearing is removed the enable line goes LOW thus instantly terminating the output to the clamp. Once this has happened the machine defaults to a standby state and further bearings can be heated subject to the conditions above.

In one example of the invention, a ferrite core was selected which was suitable for use at frequencies of 20 KHZ. Type Philips A320 KP 9012 was used of size 94 mm in length, 27 mm in width and 16 mm in thickness and several were assembled together to form the heater as shown in FIG. 1. These were wound with 166 turns of 2×1 mm copper wire.

A phase locked loop system is included to cause the main current to run at a frequency that produces a power factor of 1 in the primary coil 53. This is to ensure that maximum power is always delivered to the load 46. (Under variable load conditions the power factor could change causing reduced power in the bearing or ring). This circuit also has the function of causing the power transistors in the invertor to switch at zero current, thus reducing the losses in them.

Variable temperature settings are obtainable with the control 51 at the set temperature point and automatic switch off of the switched mode power supply is effected together with an audible buzzer. Measurement of the temperature rise can be shown using a liquid crystal display.

If, while setting up a workpiece to be heated, the circuit across the temperature sensor is incomplete or the temperature sensor was not fitted to the workpiece, a safety circuit will disable the switched mode power supply thereby inhibiting activation of said supply.

The invention allows high inductive heating with low power input.

The above embodiment herein discussed is not meant to limit the scope of the invention and its underlying theory. Other embodiments will be obvious to those skilled in the art.

That which is claimed is:

1. An induction heater for a ring-like article comprising:

a clamp-like magnetically permeable core of a ferrite material having a hinged portion movable between an open and closed position, the core permitting the mounting of the ring-like article around a portion of the core when the core is in its open position;

a winding surrounding the core for energizing it, the winding forming the primary of a transformer system with the article forming the secondary of the transformer system;

a switched mode high frequency power supply connected to the primary winding, the switched mode power supply operating at a sufficiently high frequency so that low magnetic flux density is produced in the core and the article to avoid the need for demagnetizing the article after it has been inductively heated;

phase locked loop frequency control means to detect the current load imposed by the article and so to control the supply frequency depending on the detected load so that the core and article are in resonance; and temperature sensing means and switching means to sense the temperature of the inductively heated article and to immediately terminate the current supply to the primary winding when the sensed temperature reaches a predetermined value.

2. The induction heater according to claim 1 in which the switched mode power supply comprises a transistor switching circuit.

3. The induction heater according to claim 1 in which the phased locked frequency control means comprises feed-back coupled amplifier means and a current detector connected downstream of the primary winding and controlling the amplifier means.

4. The induction heater according to claim 1 wherein the temperature sensing and switching means comprises a temperature sensor to sense the temperature of the inductively heated article, a manually operable switch, actuating means to activate the frequency control means in response to closing of the switch, and deactivating means to deactivate the frequency control means in response to sensing of the predetermined temperature value by the sensor.

5. The induction heating means according to claim 4 wherein the predetermined temperature value is the value of the difference between the temperature of the article and the ambient temperature.

* * * * *